United States Patent [19]

Magni

[11] 4,027,375

[45] June 7, 1977

[54] DEVICE FOR ANGULARLY CENTERING A MEMBER HAVING AN ANNULAR TOOTHED FORMATION

[75] Inventor: Antonio Magni, Lucca, Italy

[73] Assignee: Axis S.p.A., Florence, Italy

[22] Filed: July 19, 1976

[21] Appl. No.: 706,201

[30] Foreign Application Priority Data

Aug. 8, 1975 Italy ..... 9513/75

[52] U.S. Cl. ..... 29/282; 29/732

[51] Int. Cl.² ..... B21D 39/04

[58] Field of Search ..... 29/271, 272, 205 R, 29/205 CM, 282

[56] References Cited

UNITED STATES PATENTS 2,873,515 2/1959 Winstrom ..... 29/205 R

FOREIGN PATENTS OR APPLICATIONS 2,407,242 2/1974 Germany ..... 29/205 CM

*Primary Examiner*—James L. Jones, Jr.

*Attorney, Agent, or Firm*—Eugene J. Kalil; James M. Rhodes, Jr.

[57] ABSTRACT

A device for angularly centering a member having an annular toothed formation, for example an electric motor commutator prior to mounting the commutator on a rotor shaft, comprises a centering bracket located in the path of movement of the member. The bracket has, at its upstream end, a ramp, followed by two laterally spaced centering profiles. If a tooth of the member engages the ramp, the bracket is resiliently deflected and the tooth thereafter engages one of the centering profiles. Alternatively, the tooth will directly engage the other of the centering profiles. When the member has been centered by either one of the two profiles, it is held in its centered position within a grooved seat to enable further operations to take place.

4 Claims, 13 Drawing Figures

Fig.5
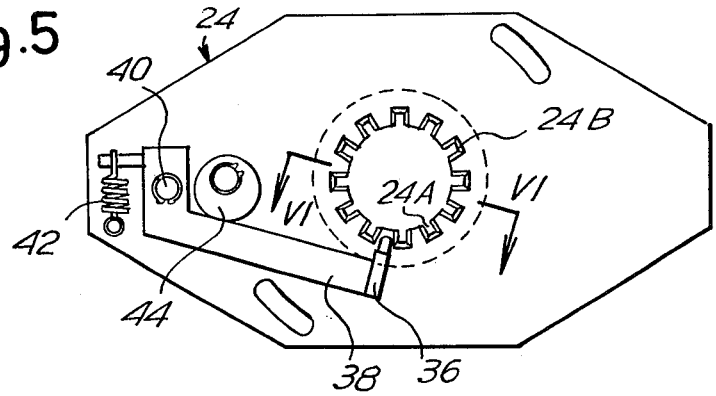
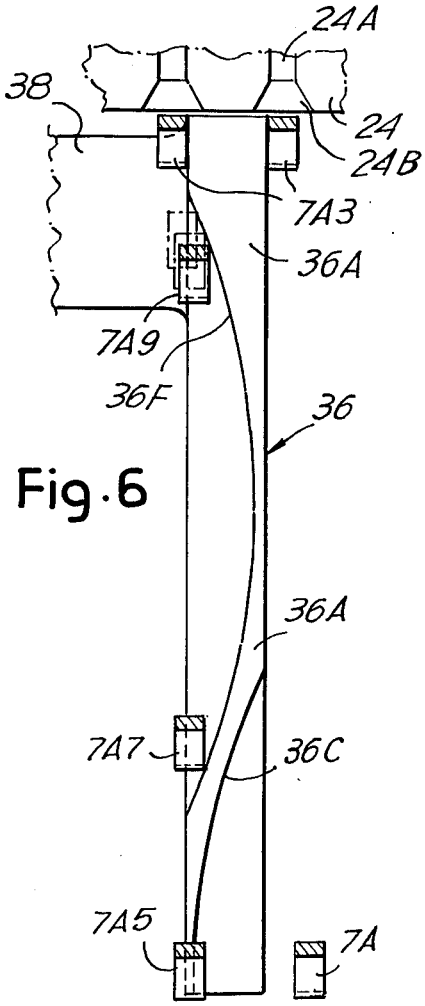
Fig.6
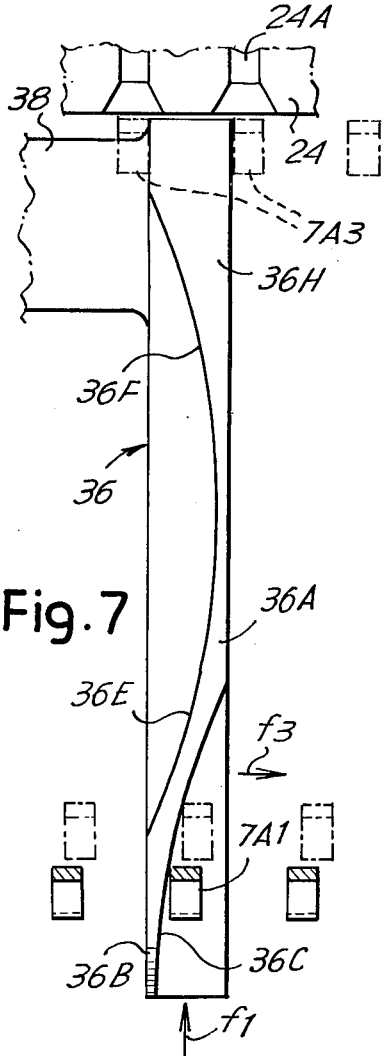
Fig.7

DEVICE FOR ANGULARLY CENTERING A MEMBER HAVING AN ANNULAR TOOTHED FORMATION

FIELD OF THE INVENTION

The present invention relates to a device for angularly centering a member having an annular toothed formation, and more particularly, but not exclusively, to a device for angularly centering an electric motor commutator prior to mounting of the commutator on a rotor shaft.

SUMMARY OF THE INVENTION

According to the invention, there is provided a device for angularly centering a member having a toothed formation, said device comprising means defining a grooved seat for slidably receiving the member, centering means for angularly orientating the member during relative movement between the member and the seat so that the toothed formation can enter the seat, said centering means comprising means defining a ramp, means defining a first profile for centering a tooth which engages the profile, and means defining a second profile for centering a tooth which has engaged the ramp, the centering means being resiliently deflected by a said tooth engaging the ramp.

BRIEF DESCRIPTION OF THE DRAWINGS

An embodiment of the invention will now be described, by way of example only, with reference to the accompanying diagrammatic drawings, in which:

FIG. 5 shows a detail of FIG. 3 to an enlarged scale;

FIG. 6 is a view, to a further enlarged scale, looking along line VI—VI of FIG. 5 and showing the centering device during one operational condition;

FIG. 7 is a view similar to FIG. 6 but showing the centering device in a different operational condition;

DESCRIPTION OF THE PREFERRED EMBODIMENT

Figure 1:
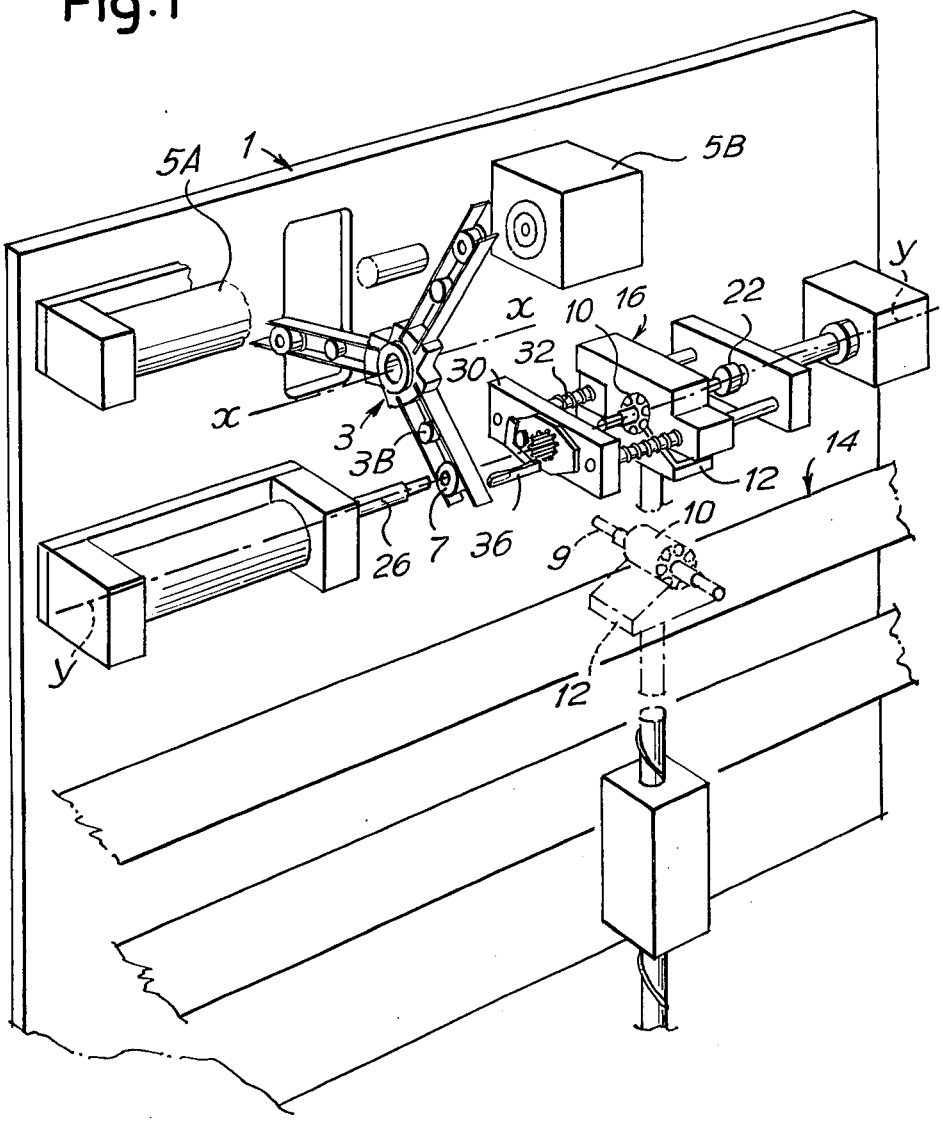
FIG. 1 is a schematic perspective view of apparatus for mounting electric motor commutators on rotor shafts, the apparatus incorporating a centering device in accordance with the invention.

As shown in FIG. 1, the apparatus comprises a structure 1 on which is mounted for rotation about an axis X—X, commutator indexing means 3 provided, in the embodiment shown, with three arms for presenting successive commutators at a mounting station. At a preceding station, each commutator is subjected to a coining or stamping operation by means of cooperating tools 5A, 5B, while at the mounting station, the mounting operation takes place using tools to be described and extending according to an axis Y—Y; in this station the commutator 7 is forced onto the shaft 9 of a rotor 10.

Figure 3:
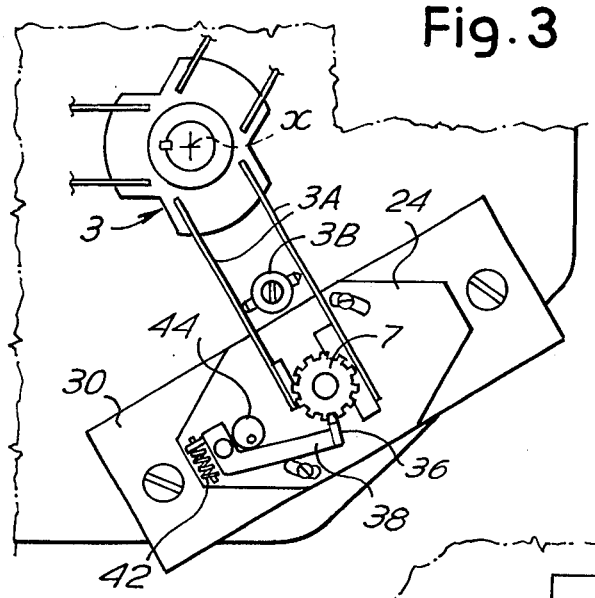
FIGS. 3 and 4 are sections taken on lines III—III and IV—IV of FIG. 2.

Each commutator 7 is carried by an arm of the indexing means 3, each arm being formed by a pair of spaced elastic plates 3A as shown in FIG. 3. One of the plates 3A of each pair carries two small blocks and the other carries a single block to enable the commutator to be gripped at three points. Each arm further comprises means 3B for diverging the two plates 3A of the arm to enable the commutator to be released from the arms.

Figure 2:
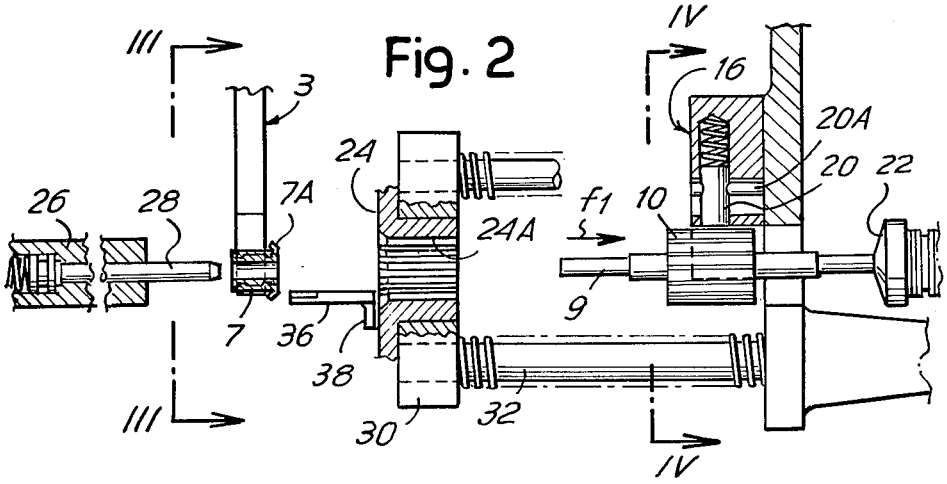
FIG. 2 is a fragmentary axial section of the apparatus.
Figure 4:
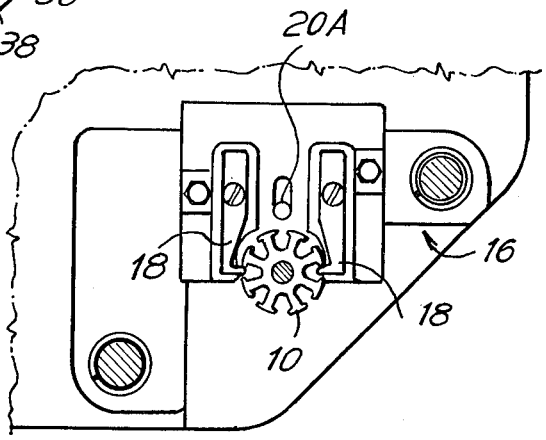
Figure 8:
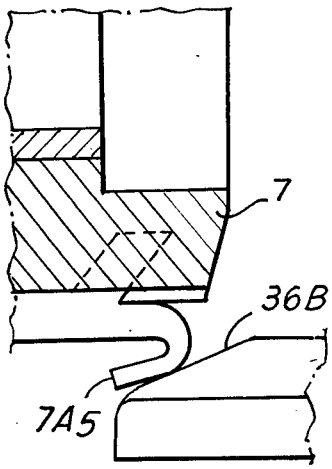
FIGS. 8, 9, 10, and 11 show several successive stages in the operation of the centering device under the condition shown in FIG. 6.

Support means 12 are arranged to pick-up the rotor 10 together with its shaft 9 from a supply conveyor 14 and to present it — appropriately orientated — to a retaining unit 16, some of whose parts are shown in detail in FIGS. 2 and 4. As shown in these FIGS., two reference teeth or jaws 18 serve to engage opposite hollow recesses of the rotor 10, and a spring biased pin 20, the stroke of which is limited by a pin 20A, is provided to permit release of the rotor 10 from the teeth 18 to enable the rotor to be returned by the support means 12 onto the conveyor 14. A stop 22 engages the end portion of the shaft 9 opposite to the end portion onto which the commutator is to be forced by movement in the direction indicated by arrow $f_1$.

Figure 13:
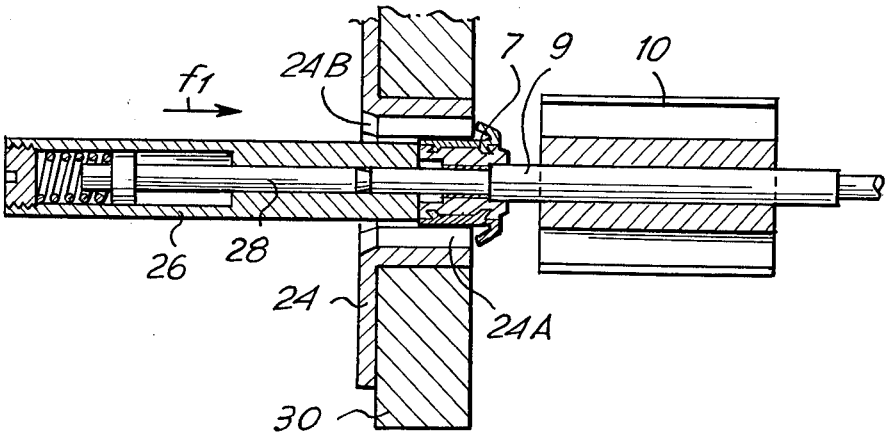
FIG. 13 is an axial section showing a thrust member of the apparatus

A centering device is provided for angularly centering the commutator 7 at the mounting station in order to guide it through a seat defined by a bore in a block 24, the bore having longitudinal grooves 24A shaped to receive hook-like teeth 7A provided at the periphery of the commutator 7. The grooves 24A preferably have enlarged inlet ends 24B, which are however, not sufficiently large to enable the insertion of the commutator 7 in the bore of the block 24, unless a preliminary angular centering of the commutator 7 has been effected. After the commutator 7 has been inserted into the bore in the block 24, an axial thrust member 26 forces the commutator 7 onto the shaft 9. The thrust member 26 is provided with a pin 28 which can be retracted within the member 26 against the bias of a spring and which can be inserted into the axial bore provided in the commutator 7 for the shaft 9. The pin 28 of the thrust member 26 transfers the commutator from the arm 3 of the indexing means, which has brought it to the mounting station, and carries the commutator in a manner to be described hereinafter, the commutator being thereafter inserted into the grooved bore in the block 24. The block 24 is carried by a structure 30 guided by rods 32 slidable on the retaining unit 16, and the assembly formed by the structure 30 and the rods 32 is movable from the position shown in FIG. 2 to the position shown in FIG. 13 in which the block 24 is adjacent to the final position of the commutator 7 on the shaft 9. Thus, during advance of the commutator 7 by means of the thrust member 26, the commutator 7 remains centered angularly in the block 24 to the end of the mounting operation.

In order to effect the above angular centering of the commutator 7 with respect to the grooved bore in the block 24, centering means in the form of a bracket member 36 is carried by an arm 38 pivoted at 40 on the structure 30 which carries the block 24. The arm 38 biased by means of a small spring 42 against a stop 44 in the form of an eccentric cam which enables the position of the arm 38 and thus the position of the bracket member 36, to be adjusted. The bracket member 36 is formed with a projection 36A (see in particular FIGS. 6 to 12) shaped with a downwardly sloping ramp 36B at its upstream end, a first lateral profile 36C, and a second lateral profile 36E opposite the profile 36C and terminating in a final lateral profile 36F; the projection 36A has at the end 36H opposite to the ramp 36B a width which is the same as the width of the bracket 36. This width corresponds to the space between two adjacent teeth 7A of the commutator 7.

Figure 9:
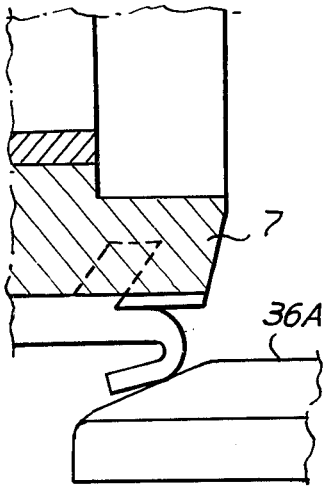
Figure 10:
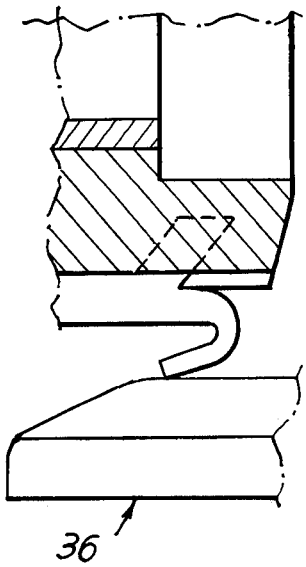
Figure 11:
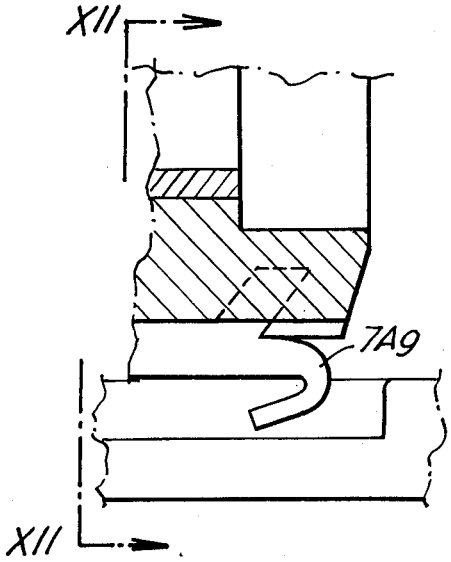
Figure 12:
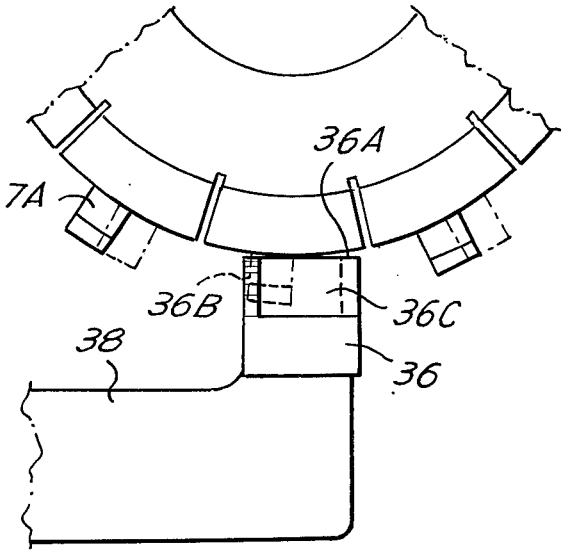
FIG. 12 is an elevation looking along line XII—XII of FIG. 11.

When the commutator is advanced in the direction of the arrow $f_1$ and meets the member 36, it may occur that a tooth 7A1 contacts the profile 36C (see FIG. 7); in this case, the commutator is angularly moved with a traverse in the direction of the arrow $f_3$ in FIG. 7, to reach the position 7A3 in which all the teeth positively engage in the inlet ends 24B of the grooves 24A of the block 24, this being ensured by appropriately positioning the bracket member 36 and the downstream end of the projection 36A relative to the block 24. If the above condition as shown in FIG. 7 does not occur, then a tooth 7A5 will meet the ramp 36B (FIGS. 6 and 8) and the bracket member 36 will be lowered, as is seen in FIGS. 9 and 10, due to the yielding of the spring 42 and lowering of of the arm 38. When the tooth 7A5 has reached the position 7A7 of FIG. 6, it no longer engages the projection 36A and the bracket 36 is returned by the spring 42 to its rest position, while the commutator is further advanced. When the tooth has reached the position 7A9 (FIGS. 7 and 11), it engages the profile 36F and is moved by the profile 36F so that at the end of the profile two teeth 7A are located in the position 7A3 as shown in FIG. 6 in which the commutator 7 is angularly centered with the teeth 7A in accurate alignment with the inlet ends 24B of the grooves 24A.

It is thus always ensured that the commutator is angularly centered with respect to the block 24 and thus with respect to the shaft 9.

When modifications occur in size or shape of the commutator it is possible to replace the block 24 and/or the bracket member 36, and/or it is possible to adjust the position of the arm 38 and thus of the bracket member 36.

Although the invention has been particularly described in relation to the centering of commutators, it can also be used for angularly centering other members having a toothed formation.

What is claimed is:

1. A device for angularly centering a member having a toothed formation, said device comprising means defining a grooved seat for slidably receiving the member, and centering means for angularly orientating the member during relative movement between the member and the seat so that the toothed formation can enter the seat, said centering means comprising means defining a ramp, means defining a first profile for centering a tooth which engages the profile, and means defining a second profile for centering a tooth which has engaged the said ramp, the centering means being resiliently deflected by a said tooth engaging the ramp.

2. A device according to claim 1, wherein the centering means comprises a resiliently biased bracket.

3. A device according to claim 2, further comprising a pivotal arm carrying said centering means, said arm being pivotal about an axis parallel to the direction of relative movement between the member and the seat, and said bracket having a longitudinal axis parallel to the direction of relative movement between the member and the seat, stop means for said arm, and spring means pivotally biasing said arm against said stop means.

4. A device according to claim 3, wherein said stop means is adjustable.

* * * * *